US008672188B2

(12) United States Patent
Rotz et al.

(10) Patent No.: US 8,672,188 B2
(45) Date of Patent: Mar. 18, 2014

(54) INTERMEDIATE PIECE FOR THE CONNECTION OF A STORAGE CONTAINER TO A STATIC MIXER

(75) Inventors: André Von Rotz, Samen (CH); Enrico Baldelli, Altdorf (CH)

(73) Assignee: Sulzer Mixpac AG, Haag (CH)

( * ) Notice: Subject to any disclaimer, the term of this patent is extended or adjusted under 35 U.S.C. 154(b) by 833 days.

(21) Appl. No.: 12/658,504

(22) Filed: Feb. 11, 2010

(65) Prior Publication Data

US 2010/0200614 A1 Aug. 12, 2010

(30) Foreign Application Priority Data

Feb. 11, 2009 (EP) ..... 09152495

(51) Int. Cl.
*B67D 7/78* (2010.01)

(52) U.S. Cl.
USPC ..... 222/145.6; 222/153.13; 222/459; 222/567; 141/346; 141/383; 366/339

(58) Field of Classification Search
USPC ..... 141/346, 383–386, 369–372; 366/181.5, 339; 222/134–137, 222/145.5–145.6, 153.04, 153.13–153.14, 222/459, 567
See application file for complete search history.

(56) References Cited

U.S. PATENT DOCUMENTS

| | | | | | |
|---|---|---|---|---|---|
| 5,080,262 | A * | 1/1992 | Herold et al. | ..... | 222/135 |
| 5,228,599 | A * | 7/1993 | Keller | ..... | 222/137 |
| 5,413,253 | A * | 5/1995 | Simmen | ..... | 222/137 |
| 5,498,078 | A * | 3/1996 | Keller | ..... | 366/339 |
| 5,988,230 | A * | 11/1999 | Black et al. | ..... | 141/18 |
| 6,135,631 | A * | 10/2000 | Keller | ..... | 366/339 |
| 6,161,730 | A * | 12/2000 | Heusser et al. | ..... | 222/137 |
| 2007/0175921 | A1 * | 8/2007 | Keller | ..... | 222/137 |
| 2007/0235546 | A1 | 10/2007 | Strecker | | |

FOREIGN PATENT DOCUMENTS

| | | |
|---|---|---|
| EP | 1 440 737 A | 7/2004 |
| WO | WO 02/074426 | 9/2002 |
| WO | WO 2004/009249 | 1/2004 |
| WO | WO2007/109915 | 10/2007 |

* cited by examiner

*Primary Examiner* — Paul R Durand
*Assistant Examiner* — Andrew P Bainbridge
(74) *Attorney, Agent, or Firm* — Francis C. Hand; Carella, Byrne et al.

(57) ABSTRACT

The intermediate piece connects a static mixer to a dispensing cartridge or to a dispensing device for a plurality of components and contains two separate passages for separate components from the dispensing device. The inlet opening of one passage includes an element for aligning the passage in a matching position to the dispensing device and the inlet openings of the two passages are of different cross-sectional shape to each other.

11 Claims, 15 Drawing Sheets

INTERMEDIATE PIECE FOR THE CONNECTION OF A STORAGE CONTAINER TO A STATIC MIXER

This invention relates to an intermediate piece for the connection of a static mixer to a storage container for components to be mixed, in particular to a dispensing cartridge or to a dispensing device.

A dispensing arrangement made up of a multicomponent dispensing device or a multicomponent cartridge as well as a static mixer is known, for example, from EP 0 730 913. The static mixer in accordance with this solution also includes a connection piece which is designed for assembly with a dispensing cartridge or a dispensing device. The static mixer and the connection piece are in this respect made as a single component which can be manufactured in the injection molding process.

It is a disadvantage of this embodiment that it is difficult to manufacture this component in the injection molding process. Complicated tools are required for this purpose in particular when the static mixer is made up of a plurality of individual mixing elements so that the mixer has a considerable construction length. The connection piece which contains the passages for the two components which should be mixed in the static mixer already has to be produced using a tool which contains cores for the manufacture of the passages. Long and complicated flow paths for the polymer melt arise due to the component geometry. The polymer melt must in every case fill up the last element furthest away from the connection piece. At the same time, it must be ensured that the component can be cooled after the end of the injection process so that the polymer melt which forms the mixer and the polymer melt which forms the connection piece solidify. In this respect, the required cooling times for the mixer can differ considerably from the cooling times for the connection piece. The cooling time for the mixer is in particular smaller than for the connection piece when the mixer is made as a thin-walled component. It follows from this that the mixer has to remain in the tool for an unnecessarily long time, namely so long until the connection piece is cooled sufficiently to be able to be demolded with stable dimensions.

It is thus an object of the invention to optimize the manufacture of the static mixer and of the connection piece in the injection molding process.

It is a further object of the invention reliably to avoid a contamination of the product to be mixed before its intended entry into a mixer and simultaneously to avoid errors in assembly.

A further object is to provide a guide means and encoding means by means of which canting of the inlets can be avoided on assembly.

Briefly, the invention provides an intermediate piece for the connection of a static mixer to a dispensing cartridge or to a discharge device for a plurality of components. The intermediate piece in this form is no longer coupled to the static mixer. This means the intermediate piece is manufactured in a separate tool, preferably in the injection molding process.

The intermediate piece contains a first passage for a first component and a second passage for a second component, with the first passage running through the intermediate piece separate from the second passage. More than two passages can naturally also be provided. A first inlet opening is provided which opens into the first passage and a second inlet opening which opens into the second passage, with the first inlet opening including an element so that the first inlet opening can be arranged in a matching position to the static mixer by means of the element. The second inlet opening can likewise have such an element. The element is in particular formed by the shape of the cross-sectional surface, with the shape of the cross-sectional surface preferably being oval, round, polygonal, that is in particular diamond-shaped or rectangular. The shape of the cross-sectional surface is thus a visual aid for the recognition of the correct installation direction. The installation direction is preset since it is important, in particular with multi-usable cartridges, that a passage of the intermediate piece always contains the same component. If this were not the case, a premature reaction of the two components to be mixed can occur due to the contamination. The premature reaction can, in particular, have the result at individual points that the quality of the material is impaired or that passages clog up, particularly when such components tend to harden.

The cross-sectional surface of the first inlet opening can differ from the cross-sectional surface of the second inlet opening, in particular when the mixing ratio of the components is not 1:1. The mixing ratio can, in particular. lie in the range from 1:1 to 1:25, preferably in the range from 1:1 to 1:10, in accordance with the embodiments in FIG. 15 from 1:1 to 1:3 and in FIG. 16 from 1:4 to 1:10, so that it is advantageous if the ratio of the cross-sectional surfaces of the first inlet opening and of the second inlet opening is matched to the mixing ratio. It is ensured in this case that the components enter into the static mixer in the correct mixing ratio.

The first passage ends in a first outlet opening and the second passage ends in a second outlet opening which are disposed at an end surface which is disposed opposite the plane which is spanned by the first and second inlet openings. The components to be mixed move from the outlet openings into the part of the mixer housing which contains the static mixer. The end face is planar in accordance with a preferred embodiment, but can also have a guide element for the deflection of the component flows which projects from the end face.

The first passage has a first inlet opening and the second passage has a second inlet opening, with at least one of the first and second inlet openings being suitable for the reception of a plug element of the dispensing device or of the dispensing cartridge. The plug element of the dispensing device or of the dispensing cartridge can, in particular, be made with tubular supports which are introduced into the associated inlet opening on the assembly of the cartridge and the intermediate piece. The shape of the outer contour, that is of the jacket of the tubular support, corresponds to the shape of the cross-sectional surface of the inlet opening. Alternatively to this, at least one of the first and second inlet openings can be made as a plug element for reception in a corresponding cut-out of the dispensing cartridge or of the dispensing device. In this case, the plug element which is in particular made as a tubular support is inserted into a matching cut-out of the dispensing cartridge or of the dispensing device. A slight excess size of the plug element with respect to the associated cut-out can be permitted. The shape of the cross-sectional surface of the plug element corresponds to the shape of the jacket of the inlet opening bounding the cross-sectional surface of the associated inlet opening.

The intermediate piece includes a first connection element designed for the reception of a housing of a static mixer, a flange adjoining the first connection element and serving as a support for the housing of the static mixer and a second connection element adjoining the oppositely disposed side of the flange and designed for assembly with a dispensing device or a dispensing cartridge. The first connection element, the flange and the second connection element contain the first and second passages. In addition, the first connection element can have a positioning element for the alignment of the static mixer with respect to the connection element and to the intermediate piece as a whole. Two positioning elements arranged opposite to each other can preferably also be provided. A plurality of positioning elements can naturally also be provided which serve to align the mixer relative to the intermediate piece.

The positioning element can in particular be designed as a projection. The first connection element includes a jacket surface to which the projection is attached. Such a positioning element has the advantage that the projection is visible on assembly so that an erroneous insertion of the intermediate piece into the static mixer is unlikely. In addition, the projection would prevent the assembly if the groove receiving it is not at the correct position so that the mixer housing and thus the mixer can only be arranged in the permitted position relative to the intermediate piece. A plurality of permitted positions can naturally also be provided when a plurality of positioning elements is present. A number of different positioning elements can also be provided to combine the intermediate piece with static mixers of different types.

The element by means of which the inlet opening can be positioned in a suitable position with respect to the dispensing cartridge or to the dispensing device can include an encoding means so that the correct positioning of the intermediate piece can be carried out on the dispensing device or the dispensing cartridge. This encoding means can be made additionally or alternatively to the inlet openings which can in turn already serve as an encoding element. Such an encoding means is particularly expedient when the two inlet openings or all inlet openings, in the event of a plurality of inlet openings are made the same, e.g. of the same diameter.

A further advantage of the use of the element as an encoding means is due to the fact that an alignment of the dispensing cartridge or of the dispensing device with respect to the intermediate piece can already take place before the plug element can come into contact with the associated inlet opening. The element in particular projects beyond the inlet opening. This means that on the assembly of the intermediate piece and of the dispensing cartridge or cartridge device, the element first engages into a corresponding mating element on the dispensing cartridge or dispensing device before the inlet openings come into contact with the discharge device or the discharge cartridge.

For this purpose, the element is in particular designed as a groove or as a projection which extends in the axial direction starting from the inlet side. The axial groove or the projection are arranged outside the inlet openings. The element can, on the one hand, be made as a groove into which a projection can engage which is arranged on the discharge cartridge or on the discharge element. The projection can in particular be made as an arm which engages in a shape matched manner into the associated groove on the inlet side of the intermediate piece.

On the other hand, the element can be made as a projection, in particular as an arm, which engages into an associated cut-out at the discharge cartridge or at the discharge device.

The advantage, in particular, hereby results that only the intermediate piece has to be replaced for the coupling of static mixers with discharge cartridges or discharge devices in order to manufacture any desired static mixer with any desired discharge cartridge or discharge device.

The element can have a first arm and a second arm which have different cross-sectional surfaces. The arms can thus only be positioned in a single position relative to the associated cut-out, which has the consequence that the intermediate piece can only be installed in a single position relative to the discharge device or to the discharge cartridge. An erroneous assembly of the intermediate piece and the discharge device or discharge cartridge can thus be precluded.

At least one of the first or second arms advantageously has a larger length than the element so that on the attempt to assemble the intermediate piece in an erroneous position relative to the discharge cartridge or the discharge device, this error is noticed before the passages of the dispensing cartridge or of the dispensing device containing the components come into contact with the inlet side of the intermediate piece.

The costs of the system, made up of the static mixer, the intermediate piece and the dispensing device or the dispensing cartridge could surprisingly be lowered by the use of the intermediate piece even though the number of parts to be manufactured has increased in accordance with the invention. The tools for the manufacture of the intermediate piece, of the static mixer and of the housing are of substantially simpler design in comparison with the prior art.

The intermediate piece can be used universally and its construction can be modified simply. "Used universally" means that any desired static mixer can be combined with any desired storage container. It is sufficient to adapt the geometry of the inlet openings of the intermediate piece to the corresponding outlet openings of the storage container, that is of the dispensing cartridge or of the dispensing device.

No excessively complicated tool is required for making the intermediate piece. The static mixer and the intermediate piece were previously made as a unit, that is, for example, in a single injection molding cycle. The manufacture in the injection molding process in particular proves to be difficult for thin-walled static mixers of large length with a complex geometry since a long flow path with a small wall thickness is required, which has the consequence of not inconsiderable difficulties for the operation of the injection molding tool.

The combination of static mixer and intermediate piece in a single component, as customary in the prior art, is in particular difficult to master from a technical injection molding aspect. In this case, a tool with cores and sliders has to be used to manufacture the intermediate piece and the pressure management and the temperature management have to be designed such that subsequently to the intermediate piece the entire static mixer is also completely filled with polymer melt, cooled and demolded in a single injection molding cycle starting from a single injection point. The cooling of such a complex component with different wall thicknesses and cavities is also complicated and/or expensive. It has surprisingly been shown that the turning away from the functional integration, that is from the concept of assembling an injection molded part from as few individual parts as possible, can result in more economic solutions. Not only the construction of the injection molding tools is simpler, but also the individual parts can be manufactured simpler and therefore faster than a single-part injection molded part. If, in this case, the static mixer, the housing for the static mixer and the intermediate piece are made as individual parts, each of the individual parts can then be optimized per se from a technical injection molding aspect. This means that the tools for each individual part have a simpler construction and that the cooling can take place more uniformly since the wall thickness of the individual parts is substantially less variable than the wall thickness of a complex, single-part injection molded part as customary in the prior art.

The static mixer can, in particular, be used for the mixing of a hardening mixed product of flowable components.

A further possible use of the static mixer is the mixture of impression compounds in the dental field or the mixture of multicomponent adhesives. or the mixing of hardening filler compounds in the construction industry sector, for example chemical dowels or anchorage elements.

The invention will be explained in the following with reference to the drawings. There are shown:

Figure 7:
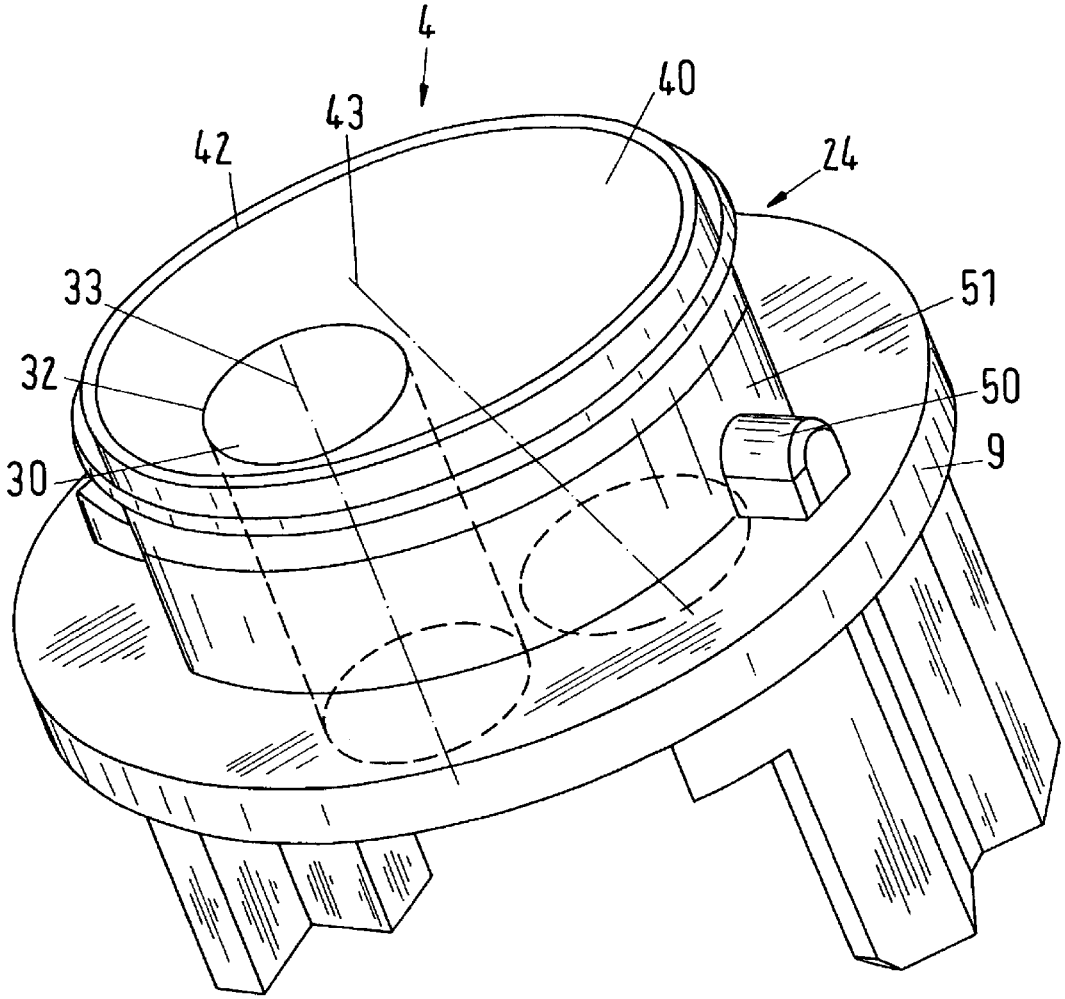
FIG. 7 illustrates a perspective view of a further modified intermediate piece in accordance with the invention.
Figure 8A:
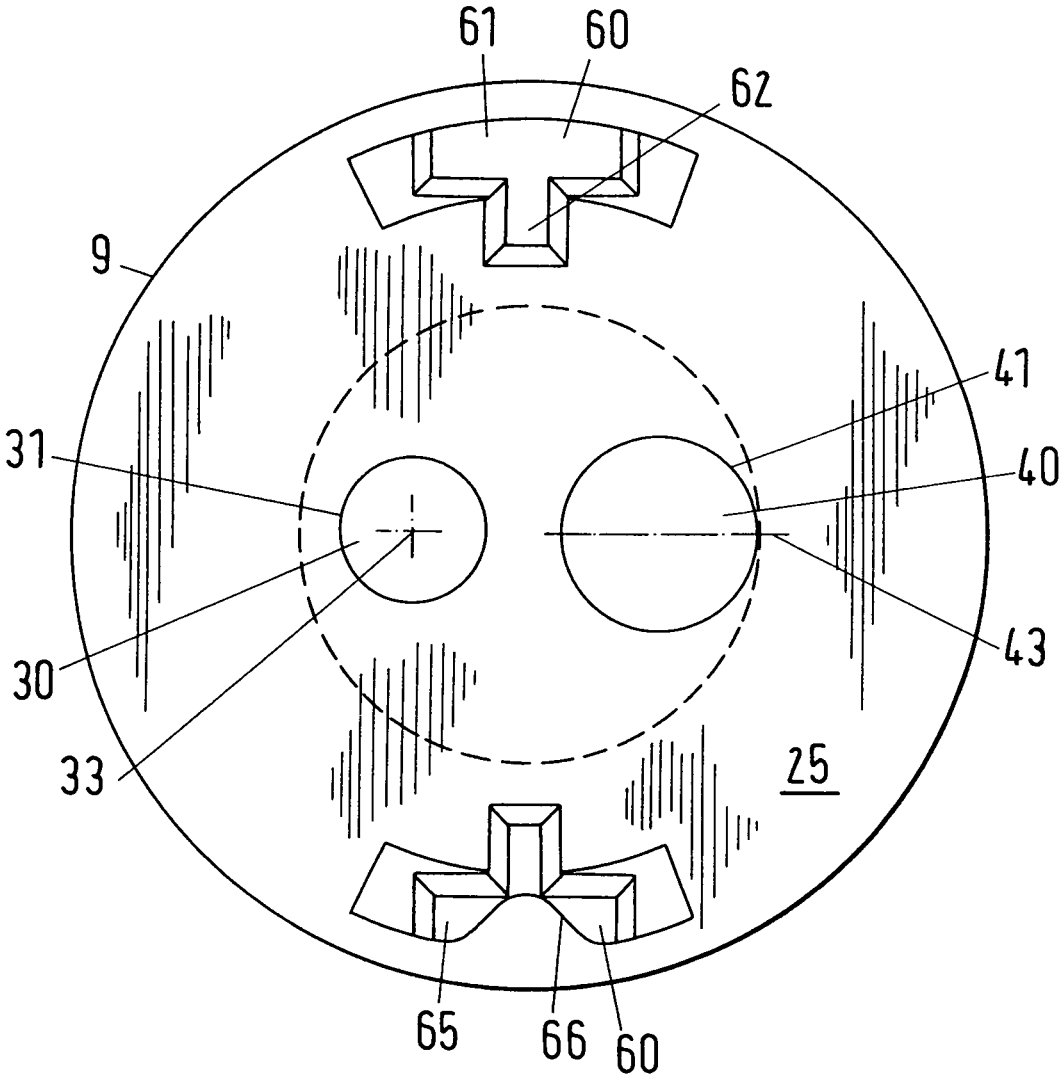
Figure 8B:
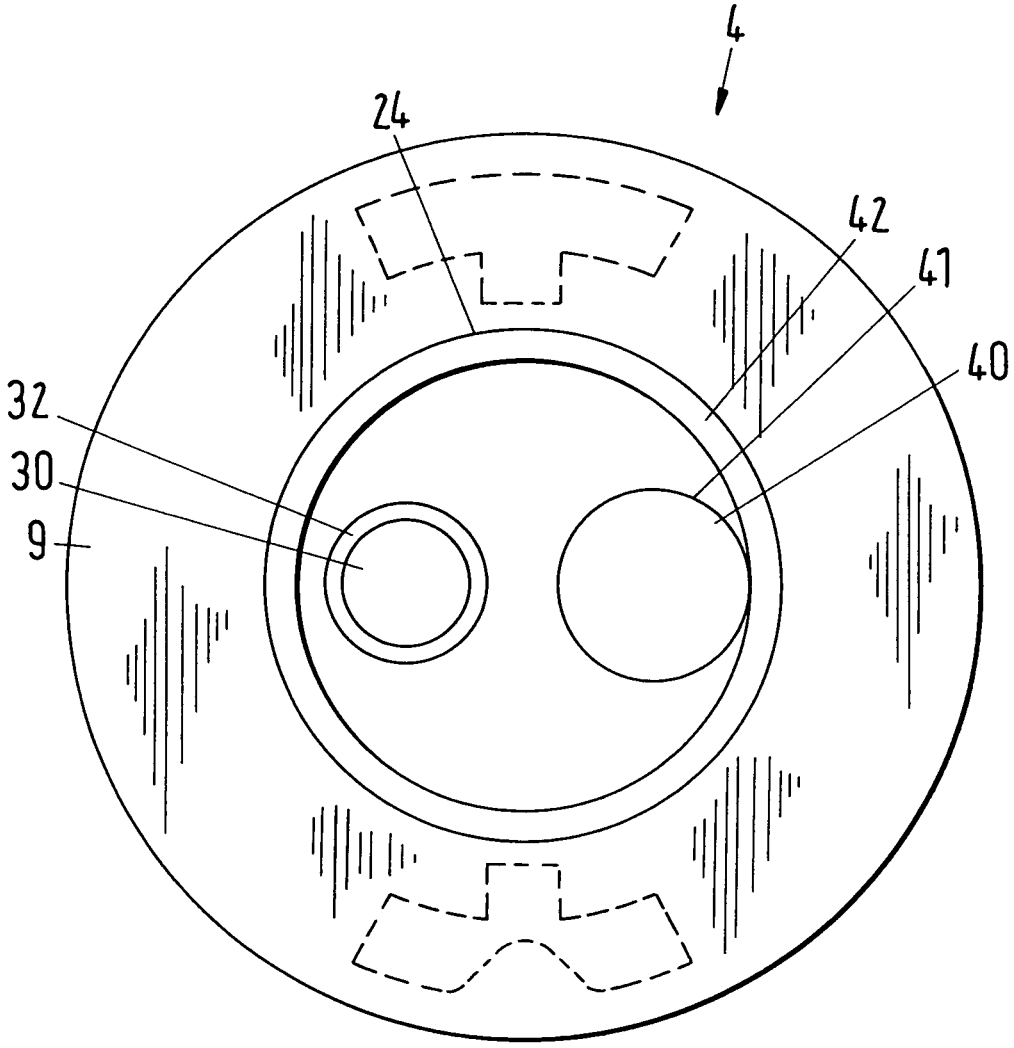
Figure 9:
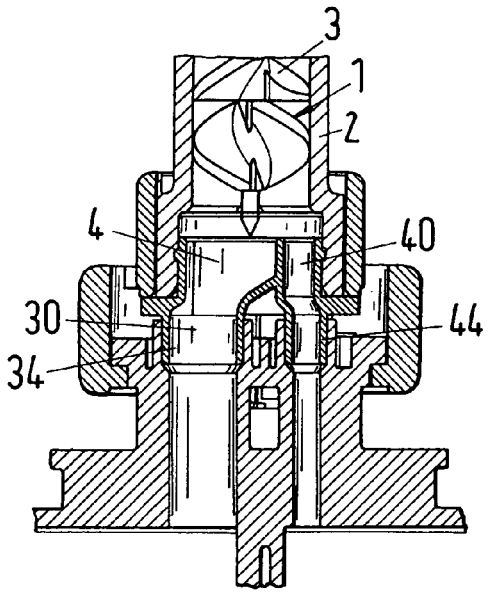
Figure 10:
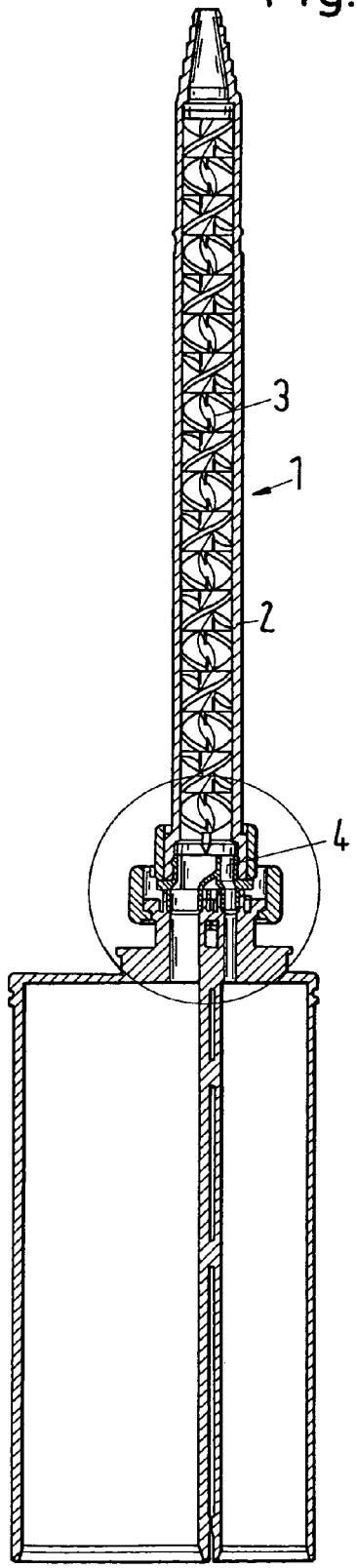
Figure 11:
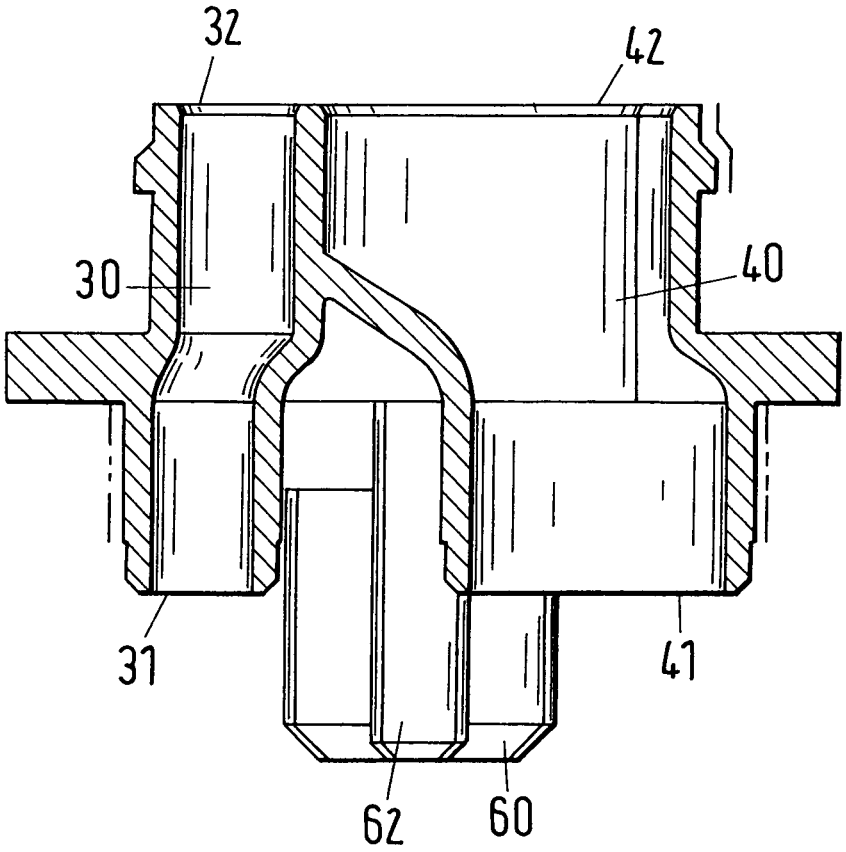
Figure 12:
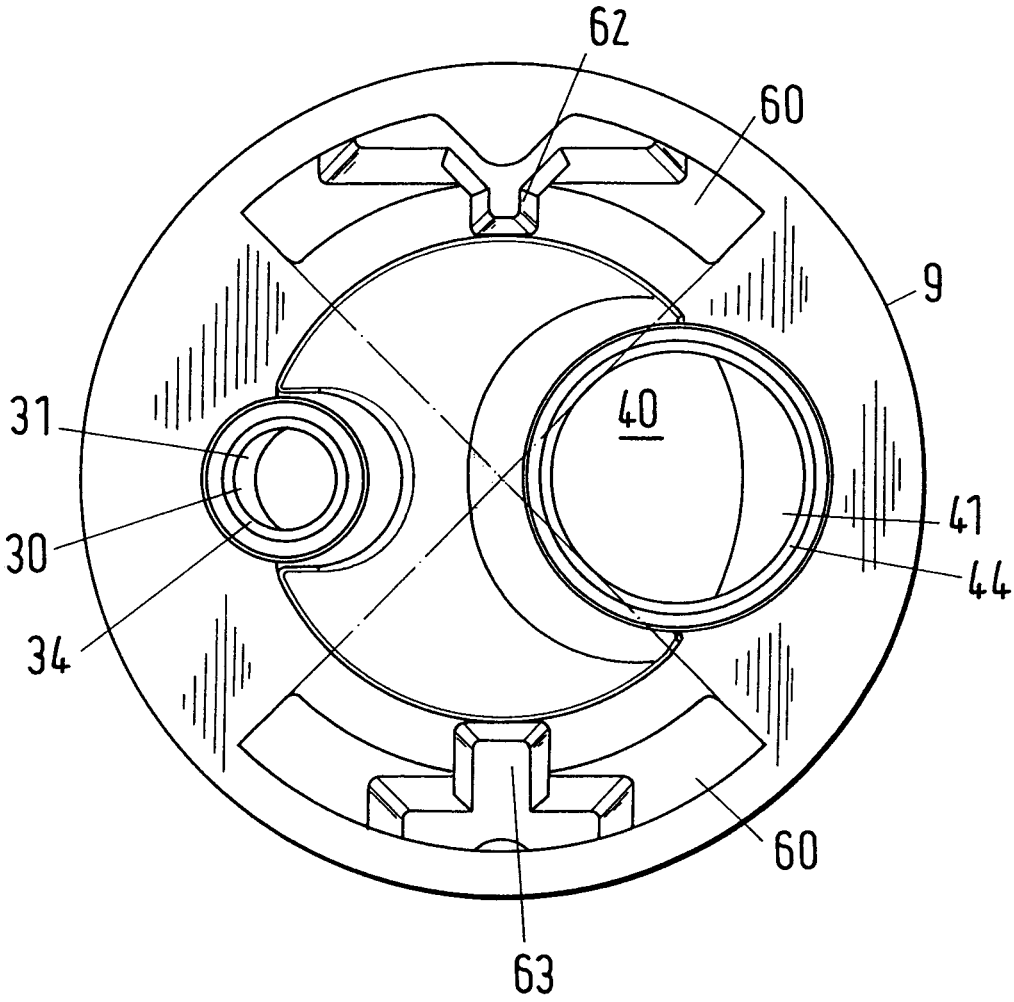
Figure 13:
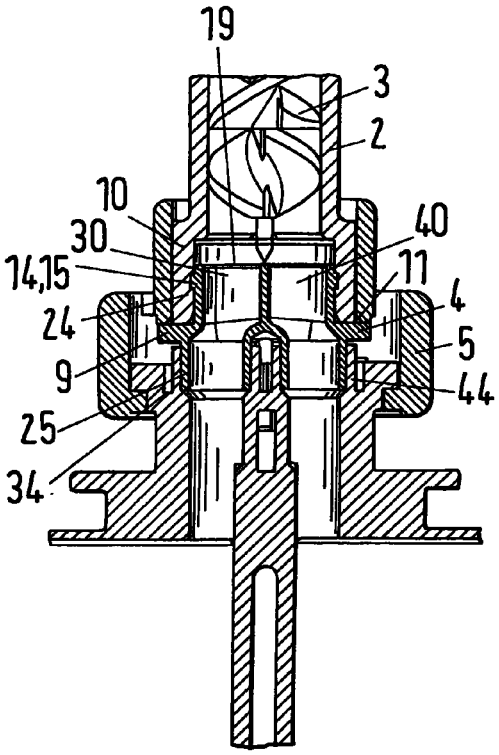
Figure 14:
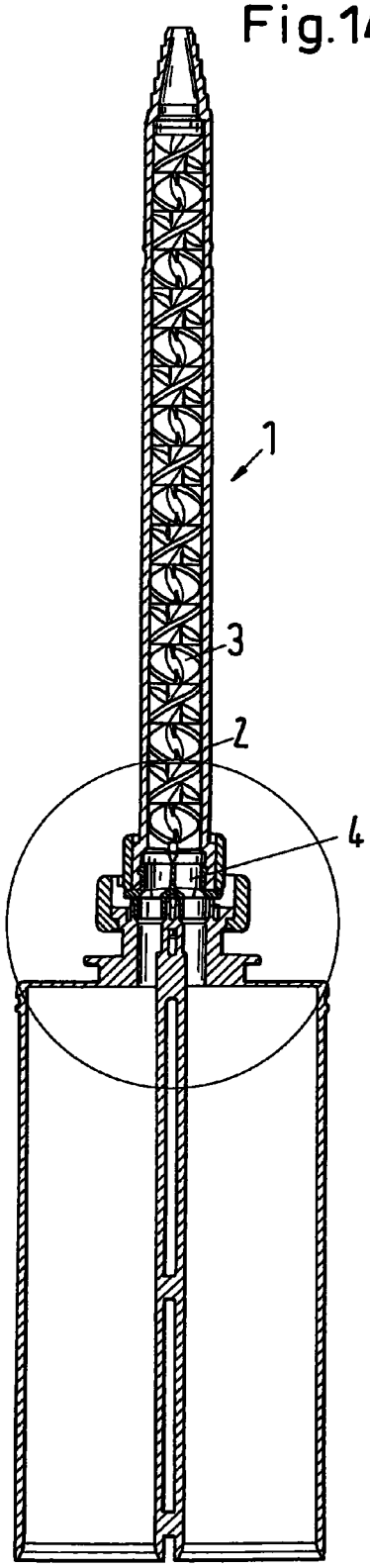
Figure 15:
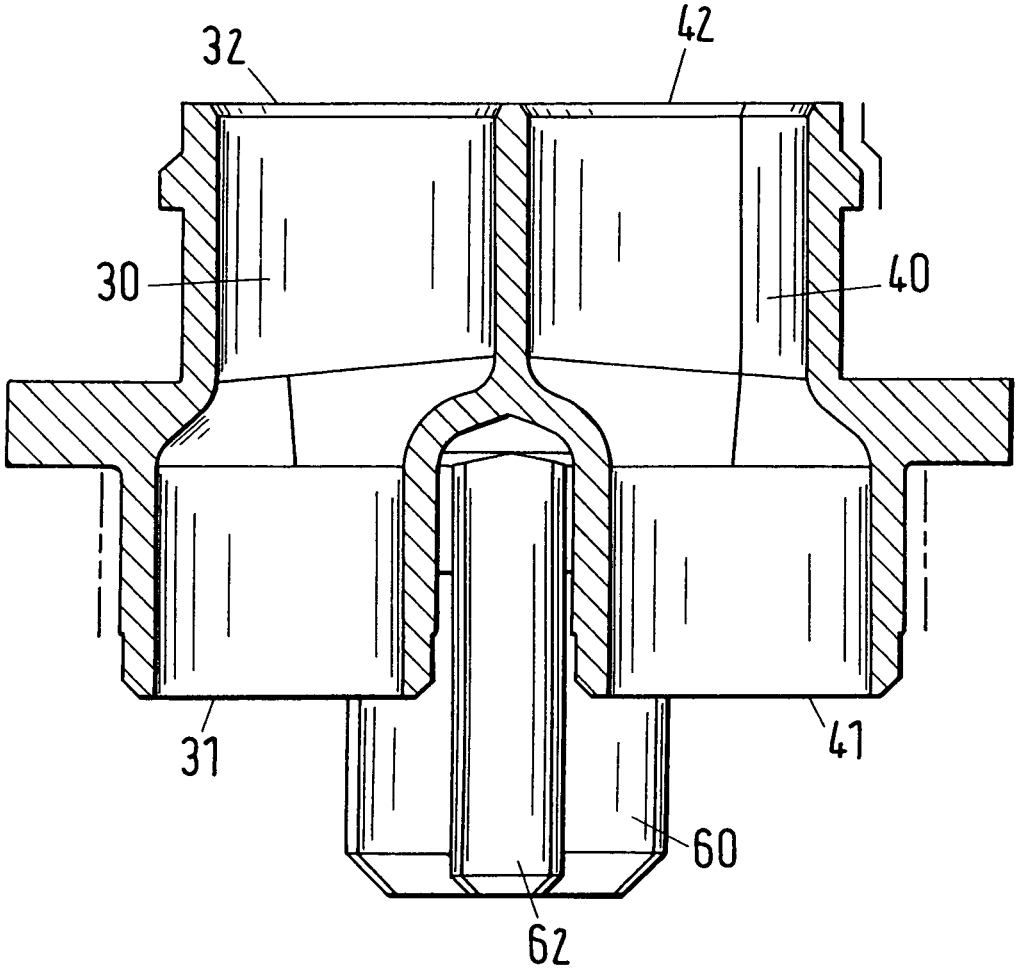
Figure 16:
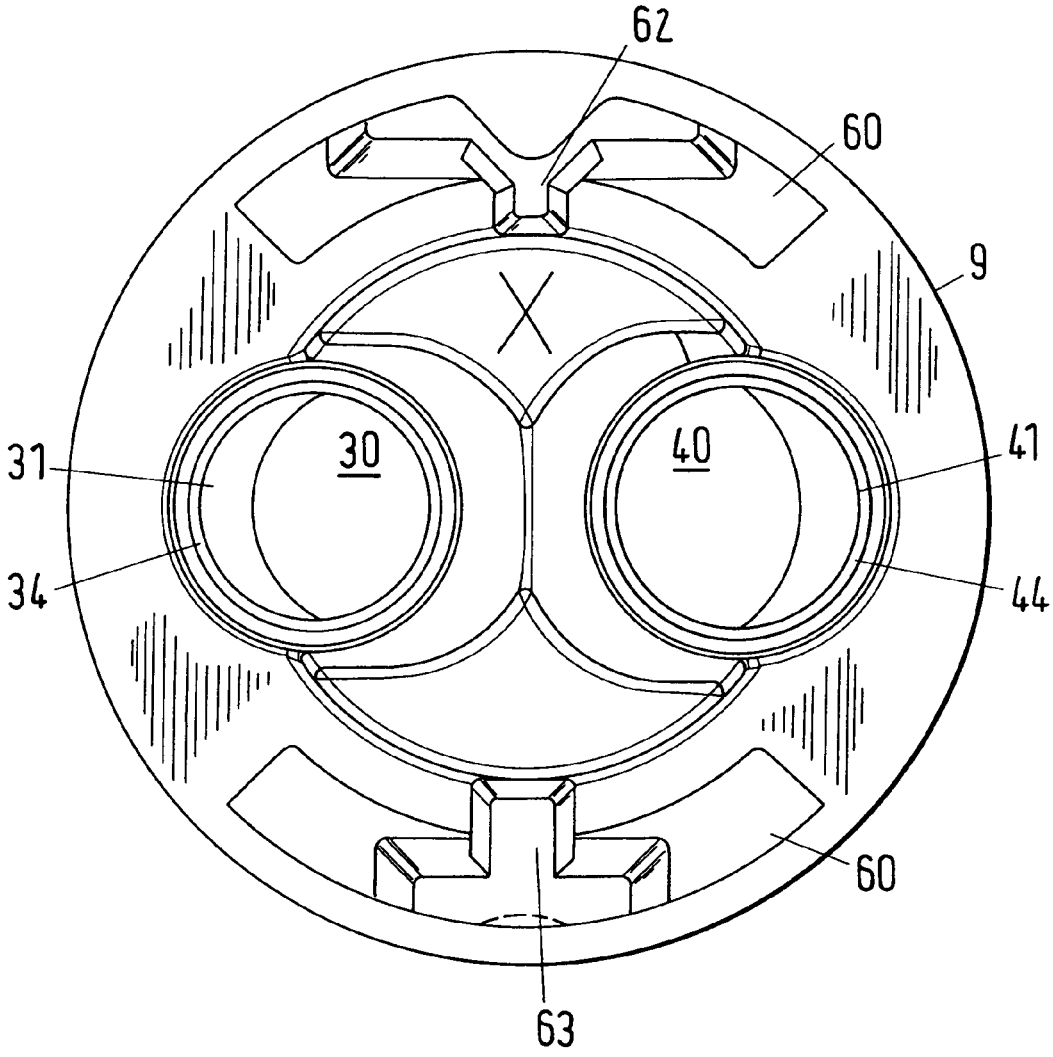

FIG. 8*a* illustrates a view of the inlet side of the intermediate piece of FIG. 7;

FIG. 8*b* illustrates a view of the outlet side of the intermediate piece of FIG. 7;

FIG. 9 illustrates a partial cross-sectional view of a further modified intermediate piece in accordance with a further embodiment connected to and between a static mixer and a dispensing device or to a dispensing cartridge;

FIG. 10 illustrates a cross-sectional view of the intermediate piece of FIG. 9 connected to and between a static mixer and a dispensing cartridge;

FIG. 11 illustrates an enlarged cross-sectional view of the intermediate piece of FIG. 9;

FIG. 12 illustrates a view of the inlet side of the intermediate piece of FIG. 9 to FIG. 11;

FIG. 13 illustrates a partial cross-sectional view of a further modified intermediate piece connected to and between a static mixer and a dispensing device or to a dispensing cartridge;

FIG. 14 illustrates a cross-sectional view of the intermediate piece of FIG. 13 connected to and between a static mixer and a dispensing cartridge;

FIG. 15 illustrates an enlarged cross-sectional view of the intermediate piece of FIG. 13; and FIG. 16 illustrates a view of the inlet side of the intermediate piece of FIG. 13 to FIG. 15.

Figure 1:
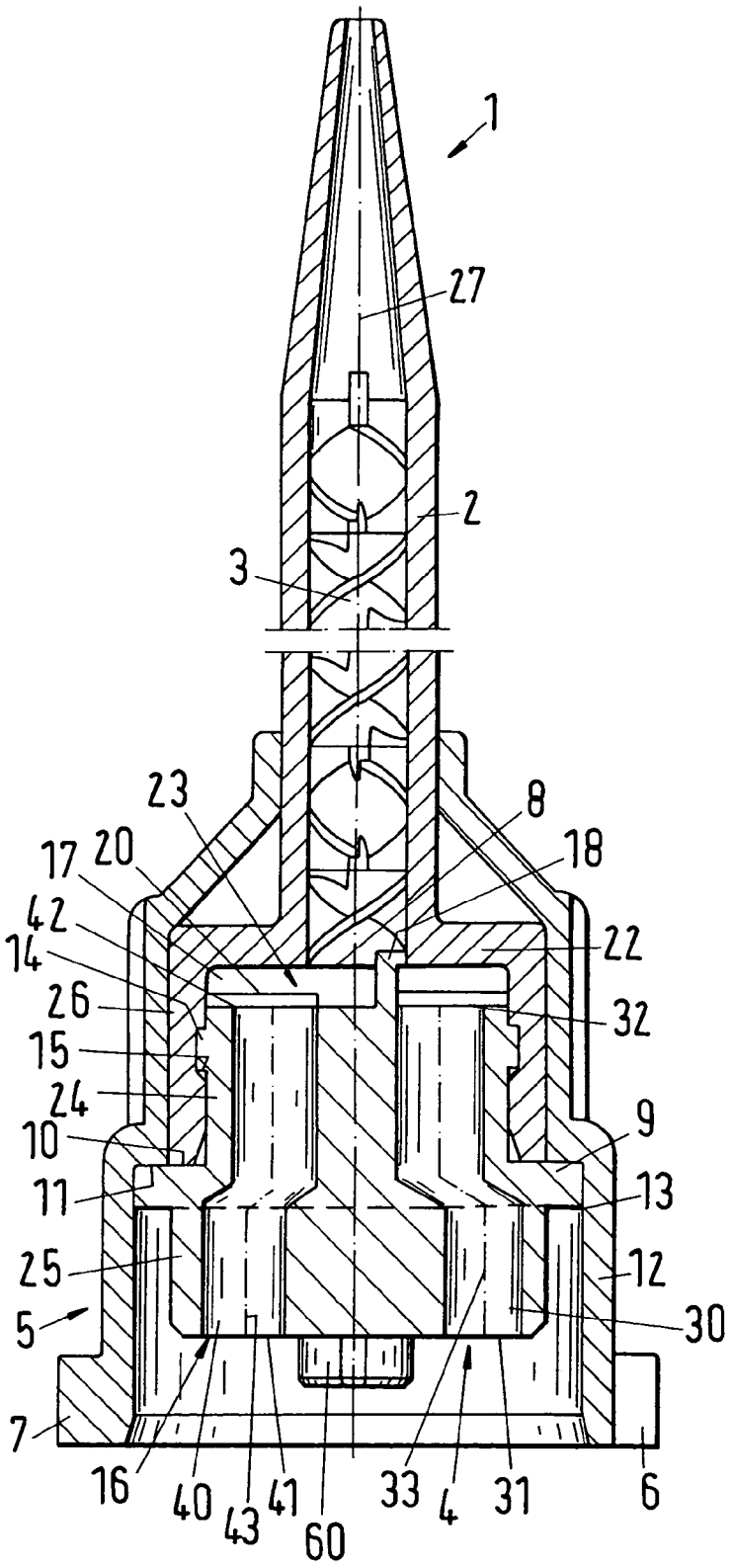
FIG. 1 illustrates a cross-sectional view through a static mixer with an intermediate piece in accordance with the invention.

Referring to FIG. 1, the static mixer 1 for a dispensing cartridge or a dispensing device for multiple components includes a mixer housing 2 which contains at least one static mixing element 3 and can, in particular, be made up of a plurality of mixing elements so that a number of similar mixing elements preferably forms a group of mixing elements. Such mixing elements are, for example, known from EP 749776 B or EP 1426099 B1 or are made as in the representation of the helical mixer with a helical structure. The mixer 1 has the function of stirring the individual components well so that a substantially homogeneous mixture arises. The mixer shown in FIG. 1 can be used for the mixing of two or more components in the same manner. The components can be in a mixing ratio which differs from a 1:1 mixing ratio.

An intermediate piece 4 is secured to the static mixer 1 for purposes as explained below.

The static mixer 1 is fastened to a dispensing cartridge or to a dispensing device for two components by means of a ring-shaped coupling element 5. The coupling element 5 contains the inlet region of the housing 2 of the static mixer as well as the intermediate piece 4.

The intermediate piece 4 contains a first passage 30 and a second passage 40 which guide a respective component to the static mixer 1. More than two passages can naturally also be contained in the intermediate piece 4 if more than two components should be supplied to the static mixer 1 separate from one another.

The coupling element 5 can, for example, be fastened to the dispensing cartridge or to the dispensing device by means of a bayonet fastening means 6, 7. In accordance with an embodiment, not shown, the coupling element could also have a connection element which engages into a mating element of the dispensing device or of the dispensing cartridge to form a latch connection, for example.

The inlet region of the housing 2 of the static mixer 1 has an inlet end 10 which serves for the reception of the intermediate piece 4. The intermediate piece 4 includes a first connection element 24 and a second connection element 25 which are separated from one another by a holding flange 9. The first connection element 24 is received in the interior of the inlet region of the housing 2 and can be held in the inlet end 10 by a retaining flange 14 which engages into a peripheral groove 15 of the inlet end 10. The first connection element 24 is thus designed for the reception of a housing of a static mixer 1. The flange 9 adjoining the first connection element 24 serves as a support for the inlet end 10 of the housing of the static mixer. The first connection element 24 as well as the second connection element 25 are cylindrical in this embodiment, but could also have a quadrangular, diamond-shaped, rectangular, round, oval or another cross-sectional surface matching the associated inlet end 10 with the same manner of operation.

The first connection element 24 can have a positioning element for the alignment of the static mixer with respect to the connection element. A plurality of positioning elements, in particular two, can also be provided. This measure is advantageously used in mixers in which the mixing quality changes in dependence on the position of the mixing elements with respect to the position of the intermediate piece. The positioning element, in particular, indicates the ideal position of the static mixer 1 with respect to the intermediate piece 4. For this purpose, the positioning element can be made as a projection 50 (see FIG. 7) which also visibly shows the position of the static mixer 1 with respect to the intermediate piece 4 and thus also provides an aid for the assembly. The first connection element 24 includes a jacket surface 51 to which the projection 50 is attached. The second connection element 25 adjoins the oppositely disposed side of the flange 9 and is designed for assembly with a dispensing device or a dispensing cartridge.

Figure 5:
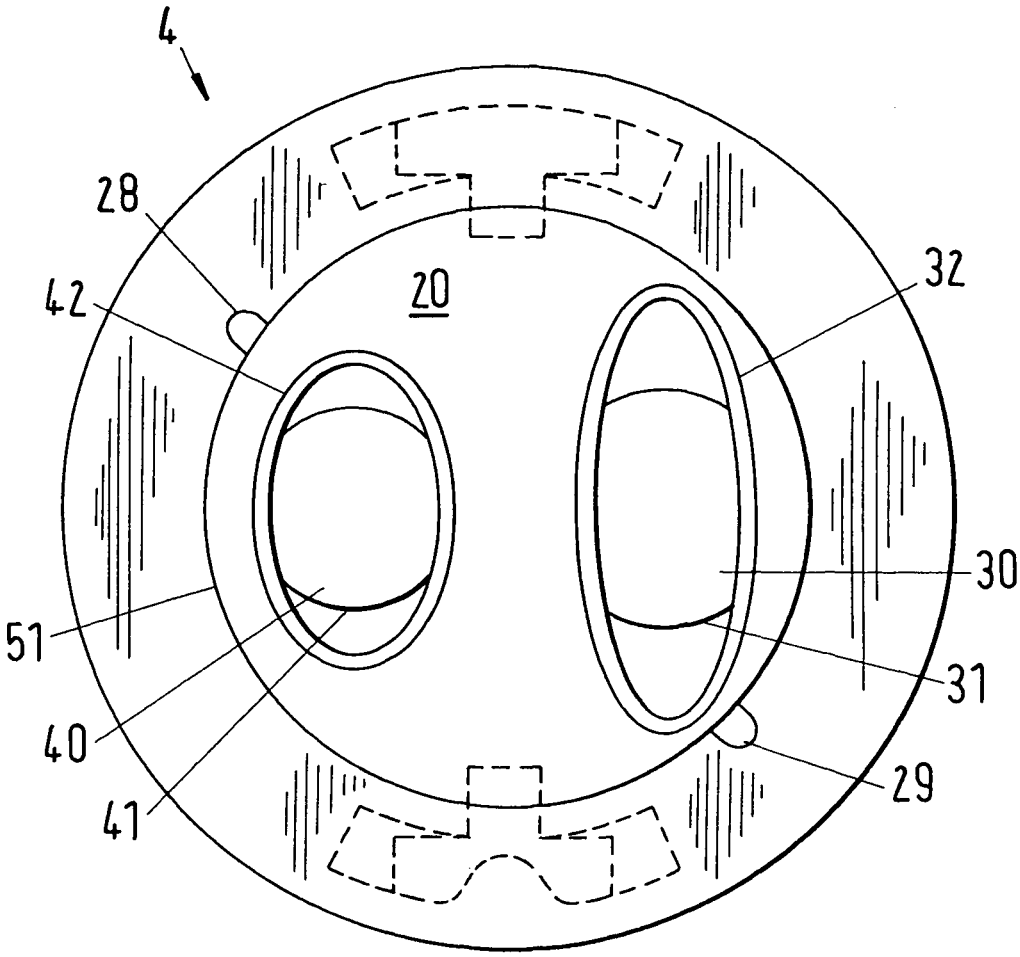
FIG. 5 illustrates a view of a further modified intermediate piece taken from the outlet side.

Referring to FIG. 5, the first or the second outlet opening 32, 42 of the passages 30, 40 can be made to be aligned in a matching position to the static mixer 1. The shape of the cross-sectional surface of at least one of the first or second inlet openings 31, 41 is, in particular, preferably not rotationally symmetrical, in particular oval or rectangular or diamond shaped.

Figure 3:
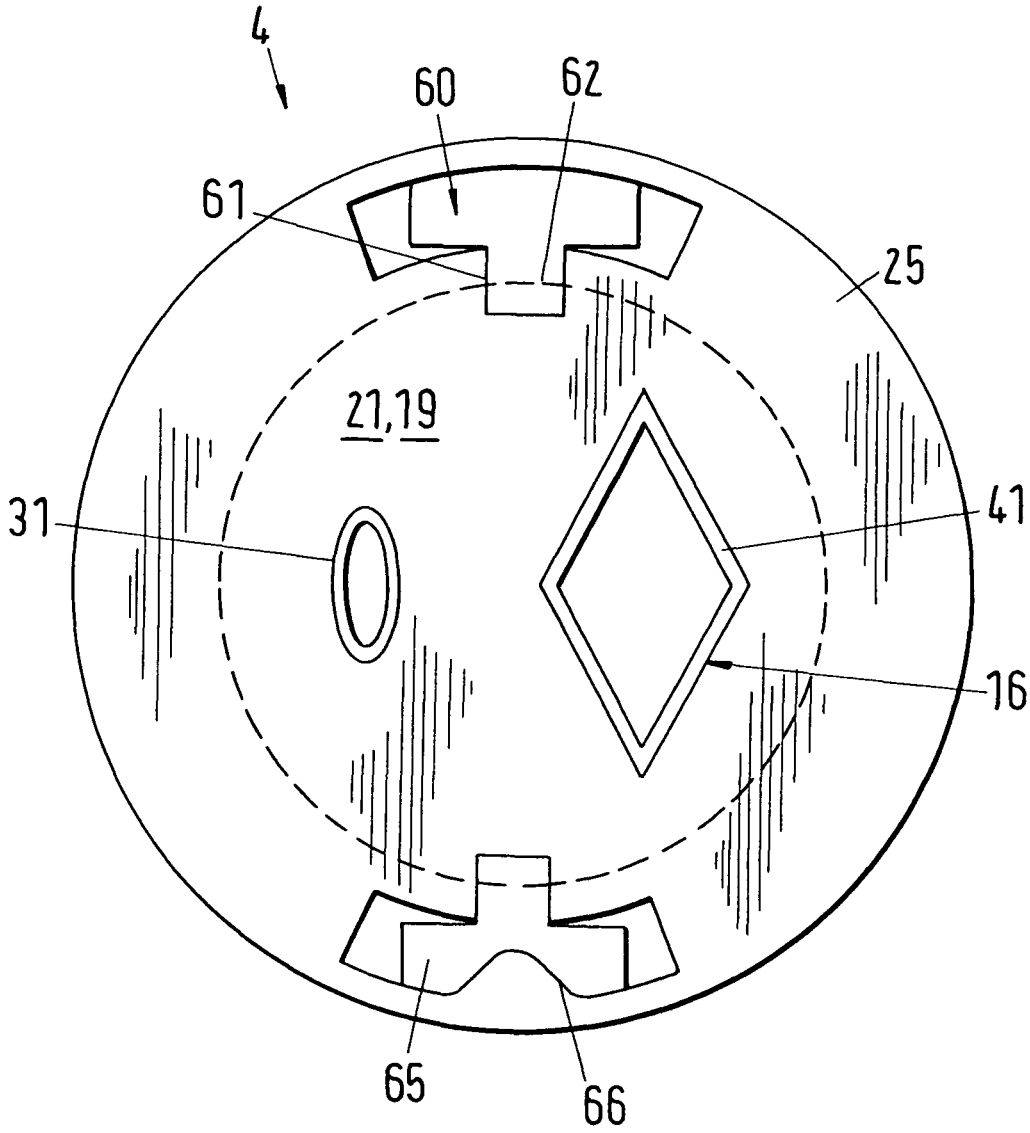
FIG. 3 illustrates a view of a further modified intermediate piece taken from the inlet side.
Figure 4:
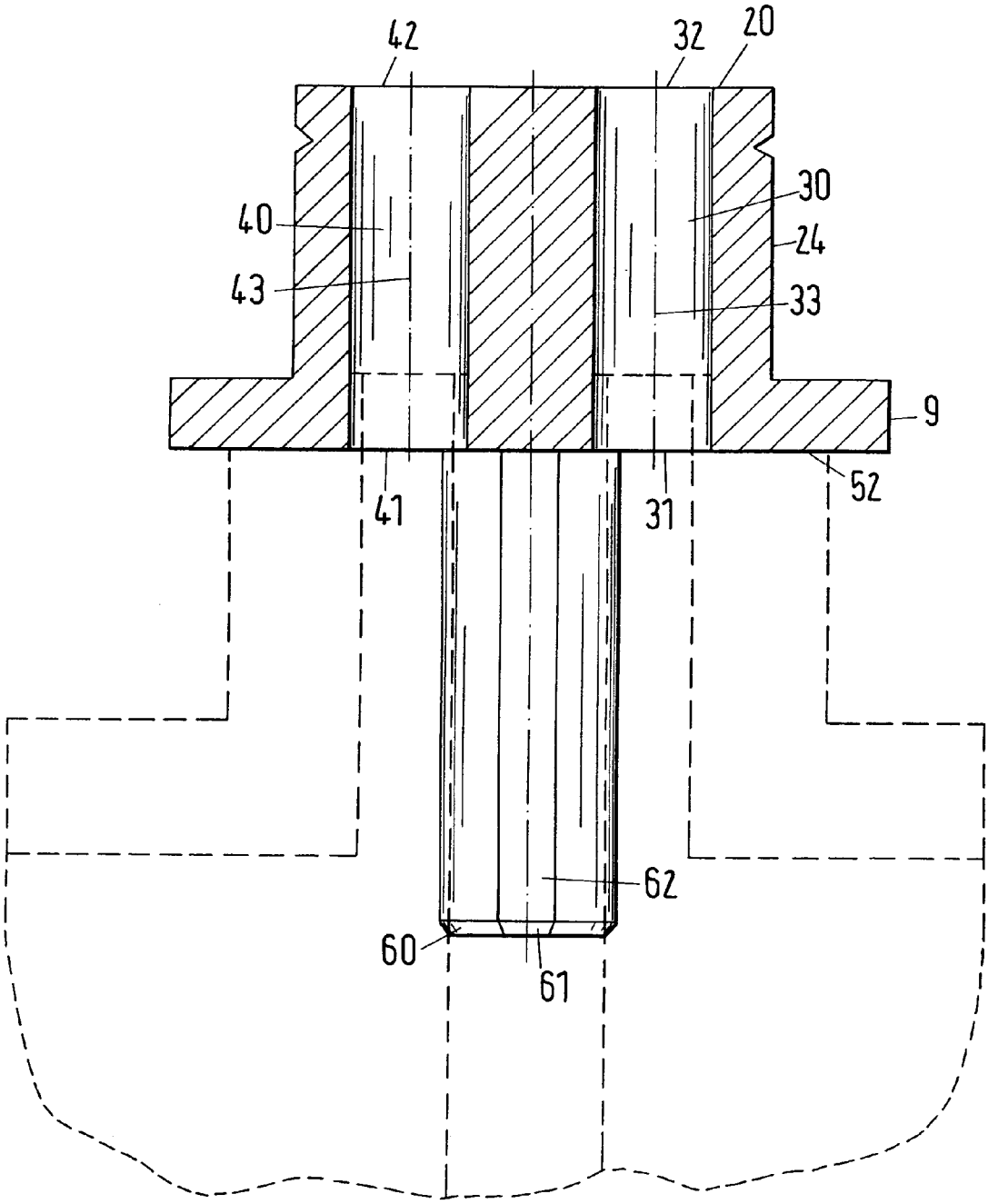
FIG. 4 illustrates a cross-sectional view through the intermediate piece of FIG. 3.

Referring to FIG. 4, the first connection element 24, the flange 9 and the second connection element 25 contain the first and second passages 30, 40. The second connection element 25 can include an encoding means. The intermediate piece 4 is in particular designed such that the first passage 30 has a first center axis 33 and the second passage 40 has a second center axis 43. The second connection element 25 includes a first encoding means 60, 61 and, optionally as shown in FIG. 8*a*, a second encoding means 60, 65, with the first encoding means 60, 61 being arranged disposed opposite the second encoding means 60, 65 with respect to a plane which is spanned by the first and second center axes 33, 43 of the passages 30, 40 (see in particular in this respect FIGS. 2, 3 and FIG. 8). In particular, the first encoding means 60 is made as an arm 61, with the arm also being able to be called a web. The first arm 61 has a finger element 62 which is designed for the engagement into an associated cut-out of the dispensing device or of the dispensing cartridge. The finger element 62 can be made as an axial rail which is designed for the engagement into an associated groove of the dispensing device or of the dispensing cartridge.

The encoding means 60 can also be designed as a groove in the outer jacket of the second connection element 25, which is not shown in the drawing here.

Only a single encoding means 60 could also be provided. If two or more encoding means 60 are provided, the encoding means also do not have to be arranged disposed opposite one another. If two or more encoding means are provided, the cross-sectional surface of at least one of the encoding means should differ from the cross-sectional surface of the further single or plurality of encoding means, in particular if the encoding means are arranged symmetrically to one another.

Alternatively to this, a plurality of encoding means 60 can also have an asymmetrical arrangement on the inlet side. Due to the asymmetric arrangement which is reflected in the same way on the dispensing cartridge or on the dispensing device, an unambiguous positioning of the intermediate piece and thus of the static mixer connectable to the intermediate piece with respect to the dispensing cartridge or to the dispensing device can take place. The cross-sectional surface of the first inlet opening 31 can differ from the cross-sectional surface of the second inlet opening 41. The element 16 has the function of an optical encoding means in this embodiment. An element 16 designed, for example, as an oval, polygonal, in particular quadrangular or diamond-shaped, cross-sectional surface is visually clearly recognizable so that the static mixer 1 can be aligned in an unambiguous position with respect to the element 16 on the assembly. The shape of the cross-sectional surface of at least one of the first or second inlet openings (31, 41) is preferably not rotationally symmetrical, in particular oval or polygonal, in particular rectangular or diamond-shaped.

The intermediate piece 4 is held in the housing 2 of the mixer 1 via the retaining flange 14. The flange 9 is matched to the inlet end 10 of the housing 2 and contacts a shoulder 11 of the inner wall of the coupling element 5.

The intermediate piece 4 has an end face 20 at its outlet-side end plate. This end face 20 can be equipped with a guide element, which is in particular made as a dividing edge 17 and/or as a partial barrier 18, for the deflection of the component flows so that the components have to flow substantially perpendicular to the longitudinal axis 27 of the mixer and parallel to the end face 20 toward a divider edge 8. The divider edge 8 is the edge of the first static mixing element 3 which faces the intermediate piece 4 and comes into contact with the two components.

The end face 20 contains the two outlet openings 32, 42 of the passages 30, 40. The dividing edge 17 is attached to the end face 20 such that each component which is discharged through the two outlet openings 32, 42 is already divided by the dividing edge 17 into two part flows, in particular into two halves. The part flows of each of the components combine in a collection chamber 23. Subsequently, the flows in the collection chamber are divided again by the divider edge 8 of the static mixer. The dividing edge 17 and the divider edge 8 advantageously stand normal on one another. This has the advantage that the component flow is divided into two part flows which differ in their composition from the part flows generated by the dividing edge 17. A first mixing stage hereby already results even before the entry of the components into the static mixing elements 3 of the static mixer 1. In particular, when the mixing ratio of the components differs from a 1:1 mixing ratio, the division of each component into at least two part flows and the subsequent combination of each of the part flows correspond to a first mixing stage because it is then ensured that the component which has the smaller volume portion enters in equal parts into the first mixing element 3 of the static mixer. Each of the part flows thus contains a portion of the first and of the second components corresponding to the mixing ratio. The entry conditions into the static mixer are thus improved by this first mixing stage.

In addition to the dividing edge 17, a partial barrier 18 and further installations for the redirection of the flow in the direction of the two part spaces of the mixing space of the static mixer divided by the divider edge 8 can be provided.

The dividing edge 17 extends in accordance with FIG. 1 from the end face 20 up to a step 22 of the housing 2 of the static mixer which surrounds the collection space 23. The step 22 connects the inlet region of the housing 2 extending from the inlet end 10 up to an inner surface 21 to the mixing space containing the static mixing elements 3.

Referring to FIG. 1, on assembly, the mixing elements 3 are positioned in the housing 2 of the static mixer 1 in a first step. In a second step, the intermediate piece 4 is connected to the inlet region 26 of the housing 2, for example via the holding flange 14 which is designed for engagement into the groove 15 which extends along the inner wall of the inlet region 26. For this purpose, the element 16 is aligned visually to the static mixer 1 so that the static mixer 1 and the intermediate piece 4 are assembled in a precisely matching position to one another.

The static mixer 1 and the intermediate piece 4 are then introduced into the coupling element 5. The intermediate piece 4 is equipped with a flange 9 which engages into a groove 13 which is located on the inside of the wall 12. The coupling element 5 is then connected via the bayonet fastening means 6, 7 to the dispensing device or to the dispensing cartridge. This connection is only established when the encoding means 60 engages into the reception means of the dispensing device or of the dispensing cartridge. In this state, the system is prepared for the mixing of the components.

Figure 2:
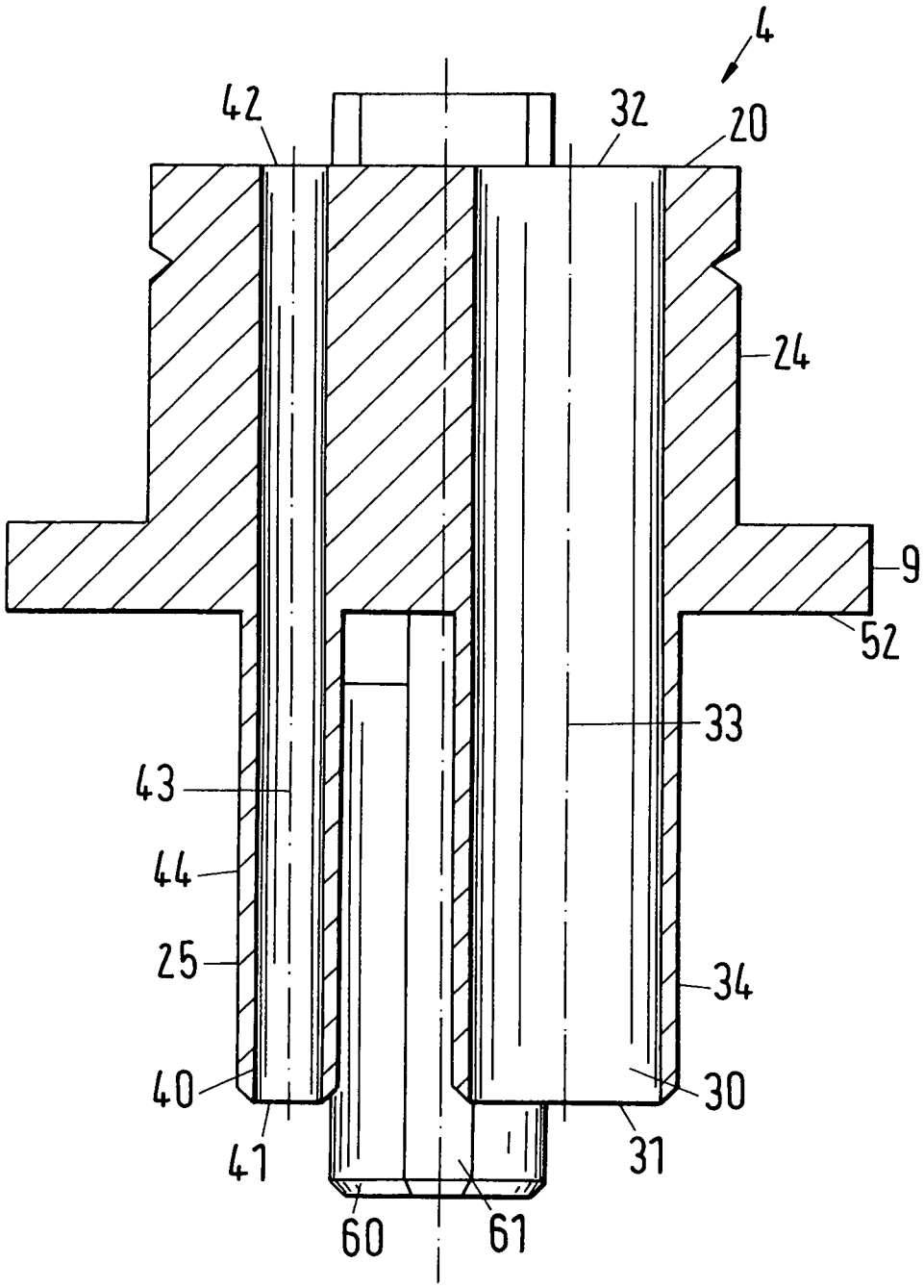
FIG. 2 illustrates a cross-sectional view through a modified intermediate piece in accordance with the invention.

Referring to FIG. 2, a modified intermediate piece 4 is made up of the first connection element 24, the flange 9 and the second connection element 25. A plurality of passages 30, 40 extend through the first connection element 24, the flange 9 and the second connection element 25. Components to be mixed are directed from a dispensing device or from a dispensing cartridge through the passages 30, 40 to a static mixer 1 (not shown) in which the two components impact one another and are mixed. There are a plurality of different dispensing devices or dispensing cartridges which serve for the storage and for the transport of the individual components. Furthermore, depending on the desired mixing ratio and the required throughput, different types of static mixers are used. These static mixers can differ by their installations, whereby the flow speed and the flow guidance changes; they can have different outer diameters so that different volume flows can be processed so that a throughput characteristic for the type of the static mixer can be achieved. The user thus has a variety of combination possibilities available in dependence on specific requirements. However, to be able to combine any desired dispensing devices or dispensing cartridges with any desired mixers, the intermediate piece 4 is used.

The passages 30, 40 of the intermediate piece 4 have inlet openings 31, 41 which can engage into a dispensing means of a dispensing device or dispensing cartridge or into which a dispensing means can engage. In the representation in accordance with FIG. 2, the second connection element 25 is made up of two pipe pieces 34, 44 which project away from the inlet side 52 of the flange 9. These pipe pieces 34, 44 are received by corresponding outlet openings of the dispensing means on assembly with a dispensing device or a dispensing cartridge, that is plugged into these outlet openings of the dispensing device or of the dispensing cartridge; they therefore represent an embodiment of a plug-in connection. So that the intermediate piece 4 is located in the correct position with respect to the dispensing device or the dispensing cartridge, an encoding means 60 can be provided.

The encoding means 60 includes an arm 61 which projects from the flange 9 in the direction of the dispensing device or of the dispensing cartridge. The arm 61 is attached to the inlet side 52 of the flange 9. The arm 61 contains a finger element 62 which is made, for example, as a bead, a rail or a projection which engages into an associated groove or cut-out of the dispensing device or dispensing cartridge when the intermediate piece 4 is assembled with the dispensing device or the dispensing cartridge. A further arm 65 which is indicated in FIG. 3 can be provided disposed opposite the arm 61. This arm 65 likewise contains an engagement element which is made as a dimple 66 here. If two arms 61, 65 are provided, they should differ from one another so that the correct position of the intermediate piece to the dispensing device or the dispensing cartridge can already be determined visually. This means that the finger element is recognizable as an indentation, a rail or a bead and the arm 65 has a dimple. Errors in the assembly can thus be avoided. In addition, the difference between the first arm 61 and any second arm helps to recognize the correct position optically. Furthermore, the arm 61 is longer than the plug elements, that is the pipe pieces 34, 44, so that the position of the intermediate piece relative to the dispensing device or the dispensing cartridge is fixed before an engagement takes place of the pipe pieces 34, 44 with the outlet openings of the dispensing device or of the dispensing cartridge. An encoding means in accordance with all other variants described in connection with FIG. 1 can naturally also be provided.

Referring to FIG. 3, the intermediate piece 4 includes the second connection element 25 which includes an end face 19 which contains the inlet openings 31, 41. At least one of the inlet openings 31, 41 is designed as an element 16 which enables a visual alignment to the static mixer (not shown). In accordance with this embodiment, the first inlet opening 31 has an oval cross-sectional surface and the second inlet opening has a diamond-shaped cross-sectional surface. Furthermore, the position of the encoding means 60 is shown which is described in connection with FIG. 2.

Referring to FIG. 4, wherein like reference characters indicate like parts as above, the first and second passages 30, 40 of the modified intermediate piece, in contrast to the embodiment of FIG. 2, have diameters that are of the same magnitude. The two components in this case are preferably in a mixing ratio which lies in a range from 1:1 up to and including 2:1. At least one of the first or second inlet openings 31, 41 is suitable for the reception of a plug element of the dispensing device or of the dispensing cartridge. The plug element of the dispensing device or of the dispensing cartridge is indicated in dashed lines. It can be a case of tubular supports which project through the inlet openings 31, 41 into the passages 30, 40. Furthermore, an encoding means 60 is shown which has the structure as in FIGS. 1-3 and will not be described in more detail.

Referring to FIG. 5, the outlet side of the intermediate piece of FIG. 4 has a first outlet opening 32 of the first passage 30 and the second outlet opening 42 of the second passage 40 on the end face 20. The first passage 30 in this case has a larger cross-sectional surface than the second passage 40. Both passages have, as shown in FIG. 4, circular inlet openings 31, 41 which are partly visible in FIG. 5. The outlet openings 32, 42, however, have an elliptical cross-sectional surface. In this case, a circular cross-sectional surface in the region of the outlet openings would have the consequence that insufficient construction space would be available for an optional dividing edge 18 or that the outlets would overlap. An oval or elliptical cross-sectional surface is therefore provided for the outlet opening whose size corresponds to the cross-sectional surface of the corresponding circular surface which has the corresponding inlet opening. In the case of FIG. 5, the first passage 30 has a larger cross-sectional surface than the second passage 40. A positioning element 29 was arranged disposed opposite a second positioning element 28 which can be made similar to the positioning element in accordance with FIG. 3.

Figure 6:
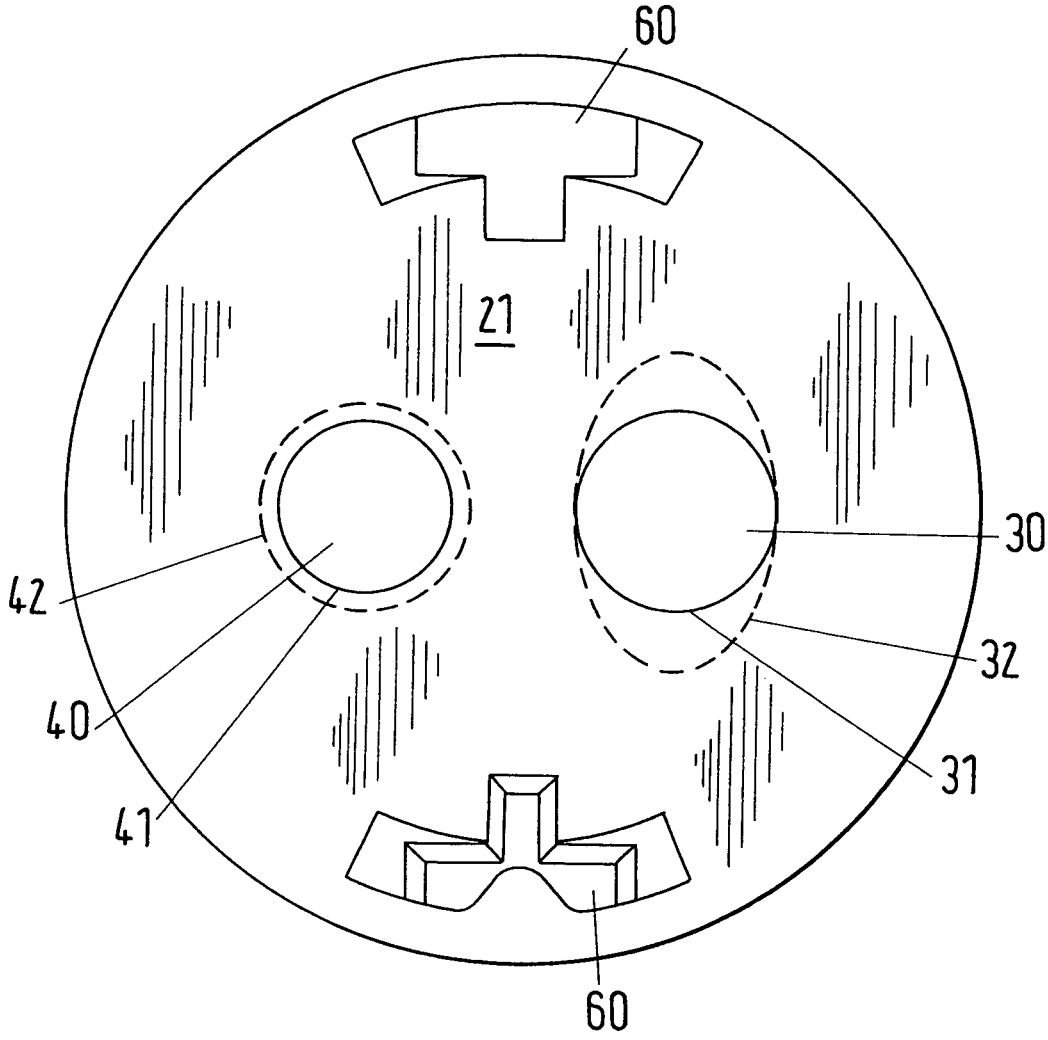
FIG. 6 illustrates a view of a further modified intermediate piece taken from the inlet side.

FIG. 6 shows a view of the inlet side 21 of the intermediate piece of FIG. 4 which is disposed opposite the dispensing cartridge or the dispensing device. In contrast to FIG. 5, the outlet opening 42 of the passage 40 was not made oval. In this case, sufficient construction space is present for the outlet opening 42 that a circular cross-sectional surface can be used which can be manufactured more cost-effectively. The oval cross-sectional surface of the outlet opening 32 of the passage 30 shown in the right hand part of FIG. 6 is thus only made use of in the case in which the construction space on the end face 20 is not sufficient to provide any partial barriers and/or dividing edges or to ensure that the mixing ratio corresponds to the ratio of the cross-sectional surfaces of the first and second outlet openings 32, 42. In particular, with mixing ratios which are in the range from 4:1 to 10:1 or more, the passage is of a smaller cross-sectional surface, in this case the passage 40, is of such a small cross-section that the transition to an outlet opening with an oval cross-section is not required for reasons of a better utilization of the space on the end face 20. In addition, two oppositely disposed encoding means 60 are shown, with reference being made to the description of FIG. 1 or FIG. 2.

Referring to FIG. 7, the intermediate piece 4 may have a cross-sectional surface of the passage 30 that differs considerably from the cross-sectional surface of the passage 40. The passage 40 may also have a cone shape to ensure the gradual transformation of the circular cross-sectional surface of the inlet opening 31 into a cross-sectional surface which forms the outlet opening 32. The outlet opening 32 surrounds the outlet opening 42. In the assembled state, tubular plug elements of the dispensing device or of the dispensing cartridge engage into the inlet openings 31, 41, as is shown in FIG. 4.

FIG. 8*a* shows the view of the inlet side of the intermediate piece 4 in accordance with the embodiment in accordance with FIG. 7. The second connection element 25 is in particular visible here which contains the first and second passages 30, 40 as well as the associated inlet openings 31, 41. In addition, the encoding means 60 are visible which have been described in connection with FIG. 2 or FIG. 3; the intermediate piece 4 thus does not differ on its inlet side from the embodiment in accordance with FIG. 6. The flange 9 also simultaneously forms the closure element 25 in this case. As in previous embodiments, the connection element 25 can also extend as a cylindrical body from the flange 9 in the direction of the inlet side.

FIG. 8*b* shows the view of the outlet side of the intermediate piece 4 in accordance with the embodiment in accordance with FIG. 7. The outlet opening 32 is in this case within the outlet opening 42. The inlet opening 41 belonging to the outlet opening 42 is visible in this representation because the cross-sectional surface of the passage 40 widens, in particular widens continuously, starting from the inlet opening. If the two passages 30, 40 were cut along a plane which contains the center axes 33, 43 of the passages 30, 40, a substantially conical cross-sectional extent can result at least for the passage 40.

FIG. 9 shows an intermediate piece 4 in accordance with a fourth embodiment which is connected to a static mixer 1 and to a dispensing device or to a dispensing cartridge. In this representation, the cross-section of a passage, here the passage 30, from the inlet opening 31 to the outlet opening 32 widens in a similar way as shown in FIGS. 7, 8*a*, 8*b*. This embodiment is in particular suitable for mixing ratios which amount to 4:1 to 10:1. In FIG. 9, two connection elements 25 are provided which are made as pipe pieces 34, 44 as in FIG. 2 and are suitable for the reception in a corresponding outlet opening of the dispensing cartridge or of the dispensing device.

FIG. 10 shows the intermediate piece 4 in accordance with FIG. 9 as well as the total static mixer 1 and the dispensing device or the dispensing cartridge.

The intermediate piece 4 in accordance with FIG. 9 is optimized in a technical injection molding aspect, which is expressed even more clearly with reference to the representation in accordance with FIG. 11. FIG. 11 is an enlarged representation of the intermediate piece in accordance with FIG. 10. The wall thicknesses of the pipe pieces 34, 44 substantially correspond to the wall thicknesses of the connection element 24 surrounding the passages 30, 40.

The passages 30, 40 have a curved extent. The curvatures are necessary to adapt the spacing of the center axes of the inlet openings 31, 41 to the spacing of the center axes of the outlet openings 32, 42. The spacing of the center axes of the inlet openings 31, 41 is preset since it has to coincide with the corresponding spacing of the outlet openings of the dispensing cartridge or of the dispensing device. The extent of the curvatures is preferably such that a minimal pressure loss arises in the passage.

An element 60, which is used as an encoding means, projects beyond the inlet openings, as already described in connection with the preceding embodiments. It includes a finger element 62 which is formed as a projection and which is designed for engagement into a corresponding cut-out of the dispensing cartridge or of the dispensing device.

FIG. 12 shows a view of the inlet side of the intermediate piece of FIG. 11. Reference is made to FIG. 6 with respect to the description of the elements designated by the same reference numerals. The embodiment in accordance with FIG. 12 differs from FIG. 6 such that the inlet openings 31, 41 are made as pipe pieces 34, 44. The intermediate space between the pipe pieces 34, 44 is not filled with material, that is material accumulations are avoided to lower the consumption of material and to achieve shortened cycle times in the injection molding process.

FIG. 13 shows an intermediate piece 4 in accordance with a further embodiment which is connected to a static mixer 1 and to a dispensing device or to a dispensing cartridge. This embodiment is in particular suitable for mixing ratios which amount to 1:1 to 1:3. In FIG. 9, two connection elements 25 are provided which are made as pipe pieces 34, 44 as in FIG. 2 and are suitable for the reception in a corresponding outlet opening of the dispensing cartridge or of the dispensing device.

FIG. 14 shows the intermediate piece 4 in accordance with FIG. 13 as well as the total static mixer 1 and the dispensing device or the dispensing cartridge.

The intermediate piece 4 in accordance with FIG. 13 is optimized in a technical injection molding aspect, which is expressed even more clearly with reference to the representation in accordance with FIG. 15. FIG. 15 is an enlarged representation of the intermediate piece in accordance with FIG. 13. The wall thicknesses of the pipe pieces 34, 44 substantially correspond to the wall thicknesses of the connection element 24 surrounding the passages 30, 40.

The passages 30, 40 have a curved extent. The curvatures are necessary to adapt the spacing of the center axes of the inlet openings 31, 41 to the spacing of the center axes of the outlet openings 32, 42. The spacing of the center axes of the inlet openings 31, 41 is preset since it has to coincide with the corresponding spacing of the outlet openings of the dispensing cartridge or of the dispensing device. The extent of the curvatures is preferably such that a minimal pressure loss arises in the passage.

An element 60, which is used as an encoding means, projects beyond the inlet openings 31, 41, as already described in connection with the preceding embodiments. It includes a finger element 62 which is formed as a projection and which is designed for engagement into a corresponding cut-out of the dispensing cartridge or of the dispensing device.

FIG. 16 shows a view of the inlet side of the intermediate piece of FIG. 15. Reference is made to FIG. 6 and to FIG. 12 with respect to the description of the elements designated with the same reference numerals. The embodiment in accordance with FIG. 15 differs from FIG. 12 such that the inlet openings are of the same magnitude. Two oppositely disposed encoding means 60 are likewise shown in FIG. 16. The two encoding means 60 have finger elements 62, 63. The first finger element 62 differs in its shape from the second finger element 63. The first finger element 62 has a smaller wall thickness than the second finger element 63. Corresponding cut-outs into which precisely one of the two finger elements fits are provided for both finger elements at the dispensing cartridge or at the dispensing device. If the intermediate piece 4 is not inserted into the dispensing cartridge or into the dispensing device in the correct position, the finger elements do not fit into the corresponding opening so that an error in the assembly will be noticed before the inlet openings 31, 41 come into contact with the filler material of the dispensing cartridge or the dispensing device.

What is claimed is:

1. An intermediate piece for connection of a static mixer to a dispensing device for a plurality of components, said intermediate piece comprising a first passage for a first component having a first inlet opening;

a second passage for a second component separate from said first passage and having a second inlet opening;

a first connection element for reception in a housing of a static mixer, a flange adjoining said first connection element for abutting the housing of the static mixer, and a second connection element adjoining said flange opposite said first connection element for communication with a dispensing device, said first passage and said second passage passing through each of said first connection element, said flange and said second connection element;

at least a first positioning element on said first connection element for alignment with a housing of a static mixer; and at least a second positioning element on said second connection element for aligning at least one of said first inlet opening and said second inlet opening in a matching position to the dispensing device.

2. An intermediate piece in accordance with claim 1 wherein said first positioning element is a projection.

3. An intermediate piece in accordance with claim 2 wherein said first connection element includes a jacket surface having said projection attached thereto.

4. An intermediate piece in accordance with claim 1 wherein said second positioning element is an encoding means.

5. An intermediate piece in accordance with claim 4 wherein said encoding means includes one of an axial groove and a projection on an inlet side outside said inlet opening.

6. An intermediate piece in accordance with claim 1 wherein said second positioning element includes a first arm and a second arm which have different cross-sectional surfaces.

7. An intermediate piece in accordance with claim 6 wherein said first arm is disposed opposite said second arm with respect to a sectional plane containing the axes of said first passage and said second passage.

8. An intermediate piece in accordance with claim 7 wherein at least one of said first arm and said second arm has a greater length than said second positioning element.

9. In combination, a static mixer having an elongated housing and at least one static mixing element in said housing;

a dispensing device for separately dispensing two flowable components; and an intermediate piece separably disposed between said dispensing device and said static mixer for conveying the flowable components from said dispensing device to said static mixing element, said intermediate piece having a first passage having a first inlet opening for receiving and conveying one of said two components from said dispensing device to said static mixing element, a second passage separate from said first passage and having a second inlet opening for receiving and conveying the other of said two components from said dispensing device to said static mixing element, and at least one positioning element for alignment with said housing of said static mixer; and a coupling element mounted on said dispensing device and receiving said static mixer and said intermediate piece therein.

10. The combination as set forth in claim 9 wherein said intermediate piece is removably mounted in said housing of said static mixer.

11. In combination, a static mixer having an elongated housing and at least one static mixing element in said housing;

an intermediate piece removably mounted in said housing of said static mixer and separably mounted in said housing from said static mixing element for conveying flowable components from a dispensing device to said static mixing element, said intermediate piece having a first passage having a first inlet opening for receiving and conveying one of said flowable components to said static mixing element, a second passage separate from said first passage and having a second inlet opening for receiving and conveying another of said flowable components to said static mixing element, said second opening having a cross-sectional surface different from the cross-sectional surface of said first inlet opening, and at least one positioning element for alignment with said housing of said static mixer; and a coupling element receiving said static mixer and said intermediate piece therein.

* * * * *